US009320927B2

(12) United States Patent
DeVaney

(10) Patent No.: US 9,320,927 B2
(45) Date of Patent: Apr. 26, 2016

(54) SPRINKLER PROTECTION SYSTEM

(76) Inventor: Nick DeVaney, Fox Island, WA (US)

( * ) Notice: Subject to any disclaimer, the term of this patent is extended or adjusted under 35 U.S.C. 154(b) by 1031 days.

(21) Appl. No.: 13/434,690

(22) Filed: Mar. 29, 2012

(65) Prior Publication Data

US 2012/0267453 A1 Oct. 25, 2012

Related U.S. Application Data

(60) Provisional application No. 61/470,306, filed on Mar. 31, 2011.

(51) Int. Cl.
*B05B 1/28* (2006.01)
*A62C 31/28* (2006.01)

(52) U.S. Cl.
CPC ..... *A62C 31/28* (2013.01); *Y10T 29/49826* (2015.01)

(58) Field of Classification Search
CPC ..... Y10T 29/49826; A62C 31/28
USPC ..... 239/288.5, 288.3, 428; 47/40.5; 169/37–42, 51
See application file for complete search history.

(56) References Cited

U.S. PATENT DOCUMENTS 1,469,336 A * 10/1923 Rowley ..... A62C 37/08 169/51
3,797,746 A * 3/1974 Gray ..... A62C 37/08 169/37
7,044,427 B2 * 5/2006 Eckenswiller ..... A47G 33/12 248/523
2007/0235621 A1 * 10/2007 Thurner ..... A47G 33/1213 248/523

* cited by examiner

*Primary Examiner* — Len Tran
*Assistant Examiner* — Joel Zhou
(74) *Attorney, Agent, or Firm* — Lowe Graham Jones PLLC

(57) ABSTRACT

A sprinkler protection system for protecting an existing sprinkler installation includes housing sections that cooperate to cover a majority of a sprinkler unit, such as a ceiling-mounted sprinkler unit. The housing sections can include one or more apertures aligned with a deflector of the sprinkler to permit the deflector to direct water through the aperture and out of the housing without significantly impeding the water output of the sprinkler and offer greater protection to the sprinkler unit.

9 Claims, 4 Drawing Sheets

SPRINKLER PROTECTION SYSTEM

PRIORITY CLAIM

This application claims the benefit of the filing date of U.S. Provisional Patent Application No. 61/470,306 filed on Mar. 31, 2011, which is herein incorporated by reference in its entirety.

FIELD OF THE INVENTION

This invention relates generally to sprinkler systems and, more specifically, to a sprinkler protection system.

BACKGROUND OF THE INVENTION

Currently there are over 6.8 billion square feet of commercial space in the United States. These spaces are comprised of businesses ranging from small retail stores to Fortune 500 companies. These spaces are protected by either a wet or dry fire suppression system that utilizes sprinkler heads for extraction of either chemical or pressurized water of the general nature show in prior art FIGS. 1-3. The average mixed-use commercial space has a sprinkler head every 150 square feet; which means there are over 45 million active sprinkler heads protecting these spaces and several hundred million heads in non-commercial and commercial space combined.

With reference to FIGS. 1-3, these sprinkler heads 10 are built with a frame 12 and a seat 14 connected to a supply 16, such as a pipe, via an adaptor 18. Each sprinkler head 10 typically includes a cap 20, an operating mechanism 22 (such as a solder link or glass bulb), and a deflector 24. The resulting automatic sprinkler together form a sealed unit that is expected to maintain its integrity, but also to operate efficiently if a fire ever threatens its protected area. The sprinkler parts are joined somewhat like a coiled spring, holding the energy needed to activate when released by heat from a fire. As shown with reference to FIG. 2, when the sprinkler head is activated, for example by heat or other pressure exerted on the operating mechanism 22, the operating mechanism breaks, releasing liquid 26 from the supply 16 via the adaptor 18. As shown with reference to FIG. 3, the released liquid is streamed towards the deflector 24 and thereafter disbursed in a predetermined but typically generally radial pattern 28.

Mechanical impacts to sprinklers can result in damage and separation of parts, causing 100-300 gallons of liquid (typically water) to be spilled per minute. This causes substantial damage and costs incurred. The tangible costs are absorbed by insurance companies, contractors, tenants, and owners; but, the intangible costs are felt by the immediate parties involved such as tenants, neighboring tenants, clients, production and sales costs from the inability to provide the services or goods, maintenance, etc.

Building renovations can result in impacts of sprinklers, leading to an inadvertent discharge or leakage and malfunction at a later date. Although it is obvious that a large force can immediately open a sprinkler, it is less obvious that a smaller impact can do the same over time.

Currently the only physical protection for sprinkler heads are wire guards that remain in place at all times. As shown with reference to prior art FIG. 4, these wire guards 30 are meant for protection of blunt force by large objects but allow for penetration of smaller objects and debris that are created when renovations are taking place. There are no current options to fully protect the head and its components from inadvertent damage that will still allow for water discharge in the event of an emergency.

SUMMARY OF THE INVENTION

This invention solves the problems associated with protecting the sprinkler heads from blunt force by large objects or the undesirable penetration of small objects and debris that are created when renovations are taking place. The invention is readily adapted to existing sprinkler heads and easily and efficiently installed, while providing dramatically improved protection of the sprinkler head and its components from inadvertent damage while allowing water discharge in the event of an emergency.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
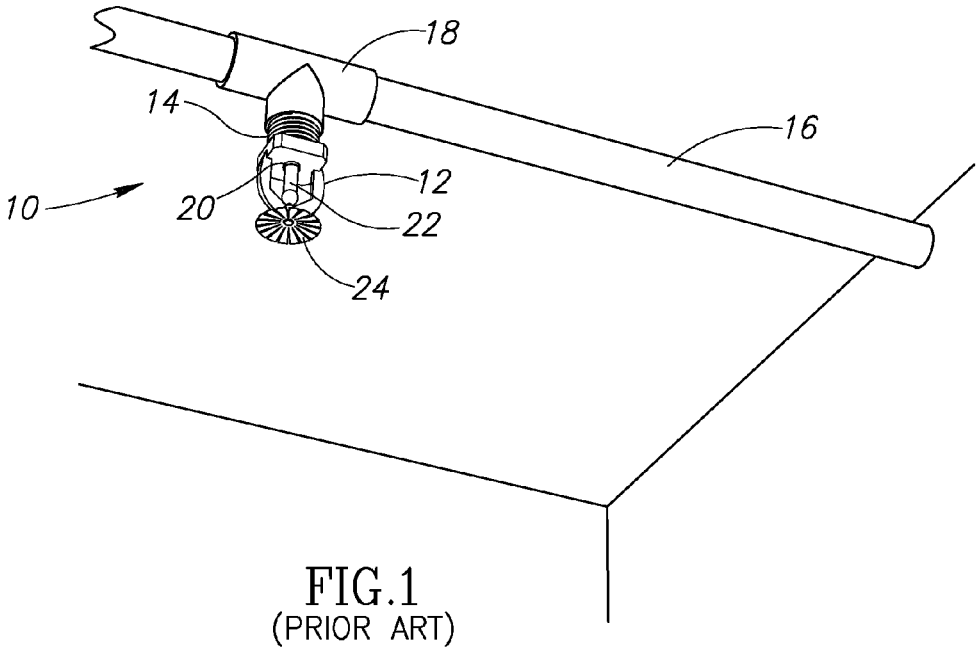
FIG.1 (PRIOR ART)
FIG. 1 is an exemplary prior art sprinkler head as may be used as part of a fire protection system.
Figure 2:
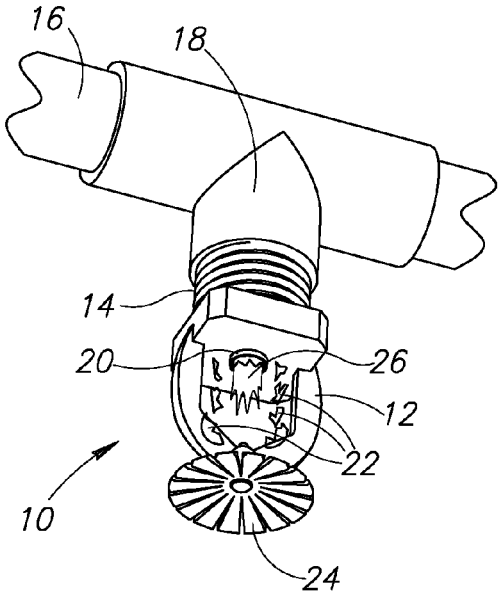
FIG.2 (PRIOR ART)
FIG. 2 is an exemplary prior art sprinkler head showing activation of an operating mechanism.
Figure 3:
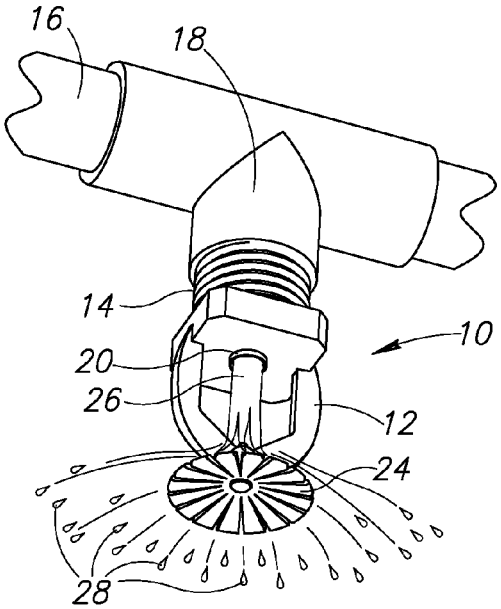
FIG.3 (PRIOR ART)
FIG. 3 is an exemplary prior art sprinkler head showing release and disbursement of fluid after activation of the operating mechanism.
Figure 4:
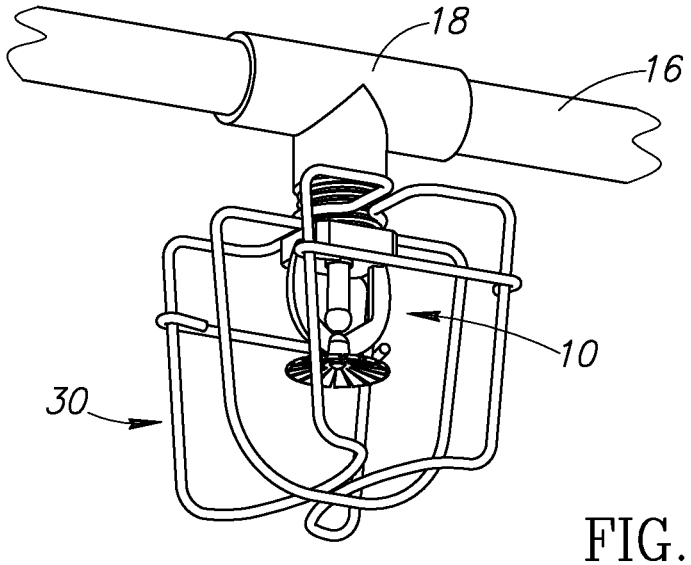
FIG.4 (PRIOR ART)
FIG. 4 is an exemplary prior art sprinkler head and a prior art wire guard.
Figure 5:
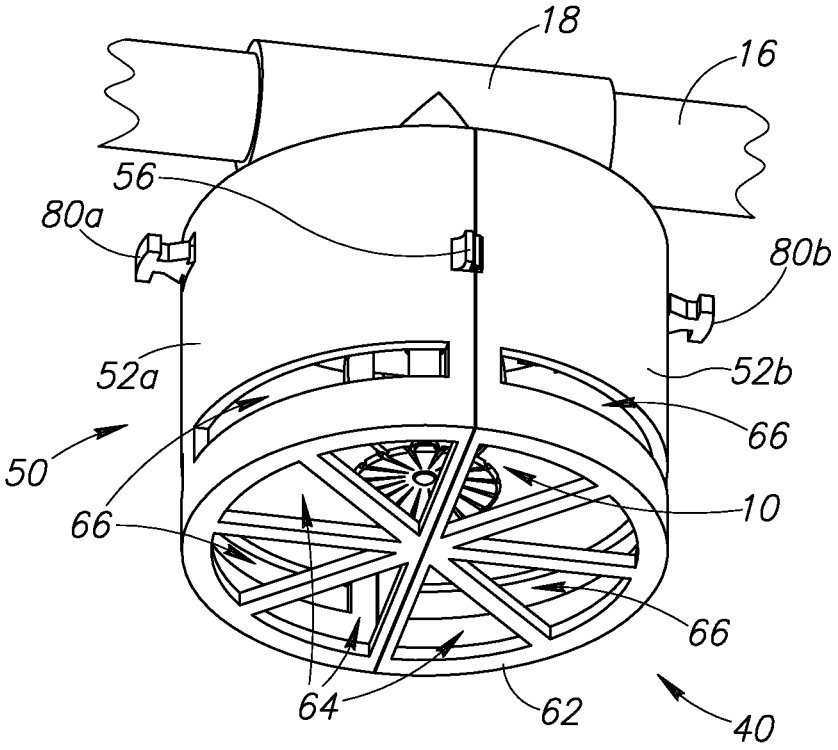
FIG. 5 is a perspective view of one embodiment of the present invention showing an installed protection system enclosing an exemplary prior art sprinkler head.
Figure 6:
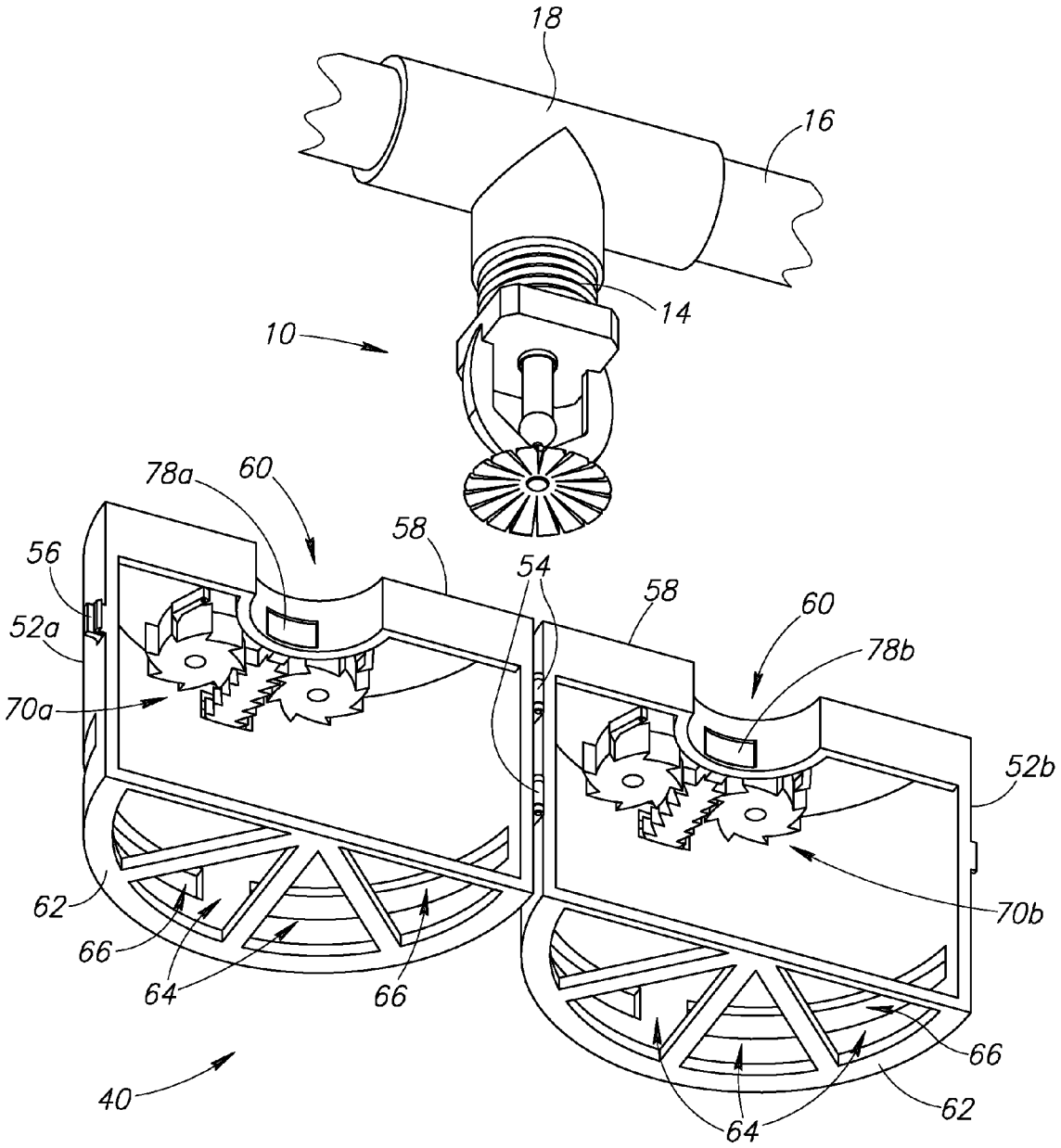
FIG. 6 is a perspective view of one embodiment of the present invention showing a protection system prior to installation on an exemplary prior art sprinkler head.
Figure 7:
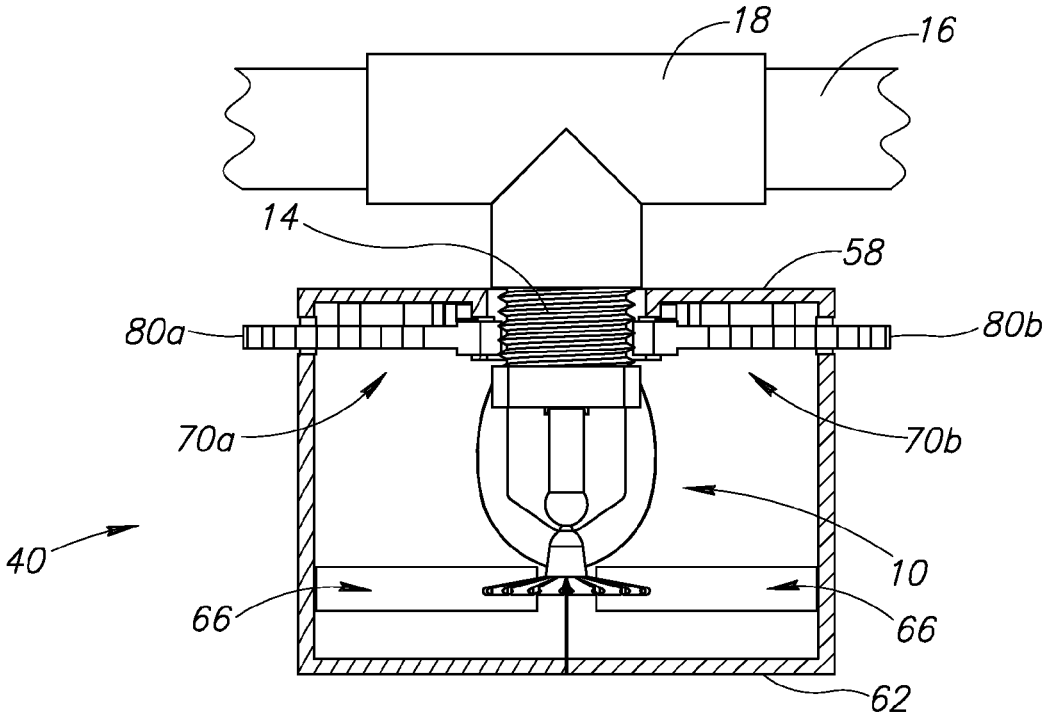
FIG. 7 is a cross-sectional side view of an installed protection system enclosing an exemplary prior art sprinkler head.
Figure 8:
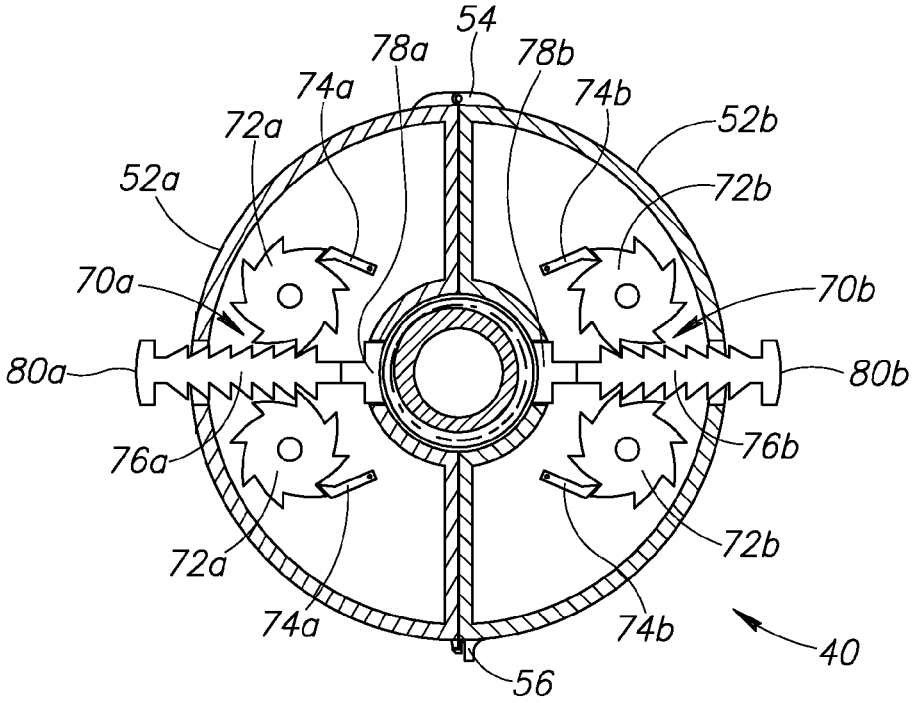
FIG. 8 is a cross-sectional top view of an installed protection system enclosing an exemplary prior art sprinkler head.

With reference to FIGS. 5-8, the preferred embodiment of the present invention is directed to a sprinkler protection system 40 having a housing 50 preferably consisting of two half sections 52*a*, 52*b* movably connected via hinges 54 and configured to close via a fastening clip 56 to form a substantially cylindrical enclosure. Each section 52*a*, 52*b* includes top surface 58 preferably having an opening 60 configured to fit around the seat 14 of the sprinkler head 10 or adaptor 18 of the supply 16 so as to secure the housing 50 above the sprinkler head with minimal or no contact with the sprinkler head components apart from the seat 14. Each section 52*a*, 52*b* includes a bottom surface 62 preferably having a plurality of openings 64 configured to allow for the exit of released liquid 26 streamed towards the deflector 24 of the sprinkler head 10 after it is disbursed in the predetermined pattern 28 (see FIG. 3).

The cylindrical half sections 52*a*, 52*b* are preferably substantially solid to provide maximum protection to the sprinkler head 10 from blunt force by large objects or the undesirable penetration of small objects and debris that are created when renovations are taking place. In one embodiment, a substantially rectangular aperture 66 is formed in the lower portion of each section 52*a*, 52*b* corresponding to the location of the deflector 24 of the sprinkler head 10 and configured to allow the disbursement of released liquid streamed towards the deflector 24 in a substantially radial direction after it is deflected according to the predetermined pattern 28. In alternate embodiment, the rectangular aperture 66 may be replaced with one or more apertures or perforations of various sizes and shapes (not shown), each of which, upon configuration to the sprinkler head distribution pattern 28, would be substantially equivalent.

In the preferred embodiment, the housing 50 supports within each section 52*a*, 52*b* a plurality of one-way ratcheting clamps 70*a*, 70*b* that are preferably pressed from the outside inward with a rubber buffer to tightly secure to the pipe. This ratchet is designed to only push inward (one way ratchet) and secure around varying sizes of drop down sprinkler pipes and will not allow for release of the pipe until the shell clamp is released and the shell is removed from the pipe and head. Each of the clamps 70 include a plurality of ratchet wheels 72*a*, 72*b* locked in place with corresponding pawls 74*a*, 74*b* and rotatably operable by depression of a two-sided arm 76*a*, 76*b*. Each arm 76 supports on an interior end a grip 78*a*, 78*b* and on an opposite exterior end a head 80*a*, 80*b*.

In preferred operation, the housing 50 is installed around the sprinkler head 10 by closing the hinged sections 52 using the fastening clip 56. Once the housing is closed, the rubber ended ratchet clamps 70 are located above the components of the sprinkler head 10 and upon operation of the clamps 70 using depression of the arms 76 to ratchet the ratchet wheels 72, the grips 78 close securely onto the seat 14 or pipe via adaptor 18. Upon installation, the apertures 66 preferably line up with the deflector 24 of the sprinkler head 10 to allow for any water that hits the deflector to exit the sprinkler protection system 40 with a minimal amount of impendence from the housing 50 as possible.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A housing for a sprinkler, comprising:

a first section having:

an upper wall;

a cylindrical half portion extending from the upper wall; and a lower wall;

wherein the half portion has an aperture aligned with a deflector of the sprinkler to permit the deflector to direct water through the aperture and out of the housing;

a second section generally similar to the first section;

a hinge connecting the first and second sections at a first side of the housing;

a clip connecting the first and second sections at a second side of the housing opposite the first side, wherein the housing is configured to be opened at the hinge and placed over the sprinkler and closed upon the sprinkler;

an arm having an end grip at a proximal end of the arm configured to engage with the seat of the sprinkler, and a head at a distal end of the arm; and a latch configured to maintain the end grip of the arm against the seat of the sprinkler and to resist movement of the arm away from the seat, the latch comprising a ratchet having a wheel with teeth and a pawl configured to prevent the arm from retreating away from the seat.

2. The housing of claim 1 wherein the arm comprises a first arm and the latch comprises a first latch, the housing further comprising a second arm generally similar to the first arm and a second latch generally similar to the first latch, wherein the first and second arms are opposite one another and configured to press the seat between them.

3. The housing of claim 1 wherein the end grip is resilient.

4. The housing of claim 1 wherein the arm extends through the cylindrical half portion and out of the housing.

5. The housing of claim 1 wherein the lower wall has an aperture to permit water to pass through the aperture and out of a lower end of the housing.

6. The housing of claim 1 wherein the apertures in the first section and the second section comprise two rectangular apertures.

7. The housing of claim 1 wherein the aperture has a vertical dimension that is slightly larger than a vertical dimension of the deflector.

8. The housing of claim 1 wherein the aperture has a vertical dimension that is approximately twice as large as a vertical dimension of the deflector.

9. The housing of claim 1 wherein the aperture is sized and positioned relative to the deflector to permit water to exit the housing with minimal impedance from the housing.

* * * * *